US005505649A

United States Patent [19]

Park

[11] Patent Number: 5,505,649

[45] Date of Patent: Apr. 9, 1996

[54] FIELD EMISSION DISPLAY DEVICE AND METHOD FOR PRODUCING SUCH DISPLAY DEVICE

[75] Inventor: Nam S. Park, Kyunggi, Rep. of Korea

[73] Assignee: Samsung Display Devices Co., Ltd., Rep. of Korea

[21] Appl. No.: 366,086

[22] Filed: Dec. 29, 1994

[30] Foreign Application Priority Data

Jul. 27, 1994 [KR] Rep. of Korea ..... 94-18358

[51] Int. Cl.[6] ..... H01J 1/30; H01J 9/02

[52] U.S. Cl. ..... 445/50; 427/78; 313/336

[58] Field of Search ..... 445/24, 50; 427/77, 427/78; 313/309, 336

[56] References Cited

U.S. PATENT DOCUMENTS 5,127,990 7/1992 Pripat et al. ..... 427/78
5,138,237 8/1992 Kane et al. ..... 313/308
5,258,685 11/1993 Jaskie et al. ..... 313/309
5,341,063 8/1994 Kumar ..... 313/309

*Primary Examiner*—P. Austin Bradley
*Assistant Examiner*—Jeffrey T. Knapp
*Attorney, Agent, or Firm*—Seidel Gonda Lavorgna & Monaco

[57] ABSTRACT

A field emission display device having thin film diamond cathodes and a method for producing the display device are disclosed. The field emission display device has an insulating layer having circular pattern apertures, and the field emission diamond cathodes formed in the apertures of the insulating layer respectively. The display device is formed by forming an insulating layer on a cathode layer, etching the insulating layer using a photoresist so as to form the apertures in the insulating layer, removing the photoresist from the insulating layer and forming a separation layer on the insulating layer, forming a plurality of thin-film diamond cathodes in the apertures and, at the same time, forming a diamond layer on the separation layer, and removing the separation layer together with the diamond layer from the insulating layer through a lift off process.

3 Claims, 1 Drawing Sheet

FIELD EMISSION DISPLAY DEVICE AND METHOD FOR PRODUCING SUCH DISPLAY DEVICE

BACKGROUND OF THE INVENTION

1. Field of the Invention

The present invention relates in general to field emission display devices used in flat panel displays .and a method for producing such display devices and, more particularly, to improvements in a structure of the field emission display device and in the production method of the display device for forming, without using a micro gate aperture forming technique, a field emission cathode, which cathode is necessary in production of a large-sized display device, into a structure suitable for lengthening the expected life span of the field emission cathode, thereby simplifying the production process and reducing the cost of the display device.

2. Description of the Prior Art

Known picture displays include cathode ray tubes (CRT) and flat panel displays, such as liquid crystal displays (LCD), plasma displays (PDP) and vacuum fluorescent displays (VFD), which flat panel displays are recently in the limelight of the display field.

The CRTs have somewhat improved efficiency in view of picture quality and luminance, nevertheless has a problem that their volume and weight are remarkably increased when increasing their sizes. This directly runs counter to the recent trend of compactness, lightness, thinness and diminution of the displays. On the contrary, the flat panel displays such as LCDs, PDPs and VFDs are more advantageous in view of the volume and weight in comparison with the typical CRTs. However, such flat panel displays have a problem that their picture quality and luminance are inferior to those of the CRTs. In recent years, field emission display devices have been actively studied and developed in order for providing the good picture quality of the typical CRTs and the structural advantage of the typical flat panel displays for the display devices at the same time. The field emission display devices are produced by precise machining of field emission cathodes in accordance with advance of semiconductor technique and by use of the field emission cathodes in the display devices.

Typically, the field emission display devices are produced by Spindt process which is a representative process for production of the field emission display devices. The most important techniques of the above Spindt process are techniques for forming a cathode tip having submicron apex and for forming gate apertures formed in a gate electrode.

FIG. 1 is a sectional view of a typical field emission display device having field emission cathodes. As shown in this drawing, both an insulating layer 3 and a gate electrode 4 are orderly formed on a cathode layer 2 of a substrate 1 and a plurality of circular pattern apertures are formed in both the insulating layer 3 and the gate electrode 4. Thereafter, a plurality of conical cathodes 10 are formed in the apertures of both the insulating layer 3 and the gate electrode 4 respectively.

In FIG. 1, the reference numeral 5 denotes a vacuum region, 6 denotes a fluorescent layer, 7 denotes an anode layer, 8 denotes a face plate glass and 9 denotes a partition.

In process for producing the above field emission display device, the circular pattern gate apertures may be formed through a photolithography. However, as H-rays having a wavelength of about 0.4 μm are used as ultraviolet rays of a pattern exposure system for the photolithography, the minimum pattern size formed through the photolithography is limited to about 1.5 μm and this causes many problems in forming of the gate apertures through the Spindt process. In addition, production of large-sized field emission display devices should be accompanied with development of a new lithography system and this restricts development of the large-sized field emission display devices. In the case of micro-tip cathode, the tip apex of the cathode has a radius of about 50 nm, so that the tip apex may be broken when there is an ion bombardment of gases remaining in the vacuum region due to electrons emitted from the cathode and this makes the microtip cathode short-lived.

SUMMARY OF THE INVENTION

It is, therefore, an object of the present invention to provide a method for producing a field emission display device in which the above problems can be overcome and which simplifies the display device production process and produces the field emission display device with low cost.

It is another object of the present invention to provide a field emission display device produced by the above method.

In an aspect, the present invention provides a method for producing a field emission display device comprising the steps of: forming a cathode layer on a substrate and forming an insulating layer on the cathode layer; etching the insulating layer using a photoresist having a predetermined aperture pattern, thus to form a plurality of apertures in the insulating layer; removing the photoresist from the insulating layer and forming a separation layer on the insulating layer; forming a plurality of diamond cathodes in the apertures of the insulating layer respectively and, at the same time, forming a diamond layer on the separation layer; and removing the separation layer together with the diamond layer from the insulating layer through a lift off process.

In another aspect, the present invention provides a field emission display device comprising: an insulating layer formed on a cathode layer, the insulating layer having a plurality of circular pattern apertures; and a field emission diamond cathode formed in each of the apertures of the insulating layer.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

In recent years, field emission cathodes which are precisely machined due to advance of Semiconductor technique are used in display devices, thus to produce field emission display devices having the good picture quality of the typical CRTs as well as the structural advantage of the typical flat panel displays.

Typically, the field emission display devices are produced by the Spindt process which is the representative process for production of the field emission display devices, the most important techniques of which Spindt process are techniques for forming a cathode tip having submicron apex and for forming gate apertures formed in a gate electrode. However, there are many problems in the field emission display devices produced by the typical Spindt process as described in the prior art.

As a result of ceaseless studies of the inventors for overcoming the above problems, the inventors develop a method for producing a field emission display device, which method removes the typical process for forming the micro gate apertures but simply produces a field emission cathode having a structure suitable for lengthening the expected life span of the field emission cathode.

Figure 1:
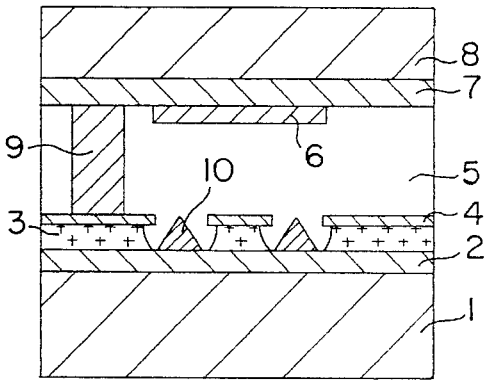
FIG. 1 PRIOR ART
FIG. 1 is a sectional view of a typical field emission display device having field emission cathodes.
Figure 2:
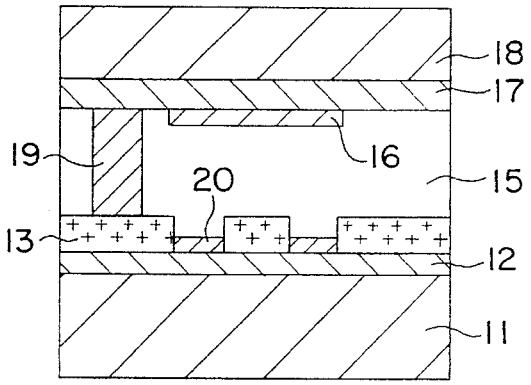
FIG. 2 is a view corresponding to FIG. 1, but showing a preferred embodiment of the present invention.

FIG. 2 is a sectional view of a field emission display device having field emission cathodes in accordance with a preferred embodiment of the invention, and FIGS. 3A to 3E are views showing a process for producing the field emission display device of FIG. 2.

As shown in FIG. 2, the field emission display device of the invention includes a cathode layer 12 and an insulating layer 13 which are formed on a glass substrate 11 so that there are formed a plurality of apertures in the insulating layer 13. A plurality of diamond cathodes 20 are formed in the apertures of the insulating layer 13 respectively.

In FIG. 2, the reference numeral 15 denotes a vacuum region, 16 denotes a fluorescent layer, 17 denotes an anode layer, 18 denotes a face plate glass and 19 denotes a partition.

Figure 3A:
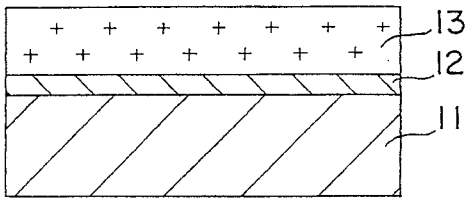
FIGS. 3A to 3E are views showing a process for producing the field emission display device of FIG. 2.
Figure 3B:
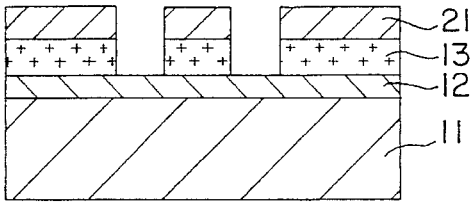
Figure 3C:
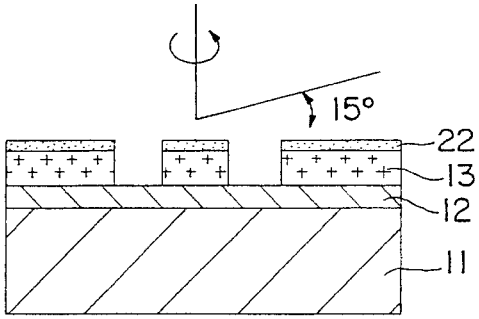
Figure 3D:
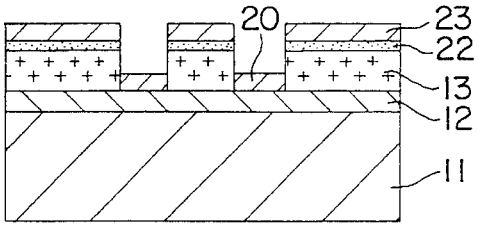
Figure 3E:
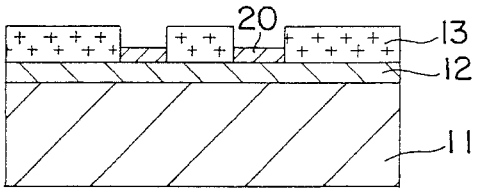

In order to produce the above field emission display device, the cathode layer 12 is primarily formed on the substrate 11 as shown in FIG. 3A. Thereafter, the insulating layer 13 is formed on the cathode layer 12. After forming the insulating layer 13 on the cathode layer 12, a photoresist 21 having a predetermined aperture pattern is applied on the insulating layer 13 prior to etching of the insulating layer 13. As a result of the etching, the insulating layer 13 is partially etched into the pattern of the photoresist 21, thus to be provided with the plurality of apertures as shown in FIG. 3B. After forming the apertures in the insulating layer 13, the photoresist 21 is removed from the layer 13. The insulating layer 13 in turn is coated with a separation layer 22 as shown in FIG. 3C. Thereafter, a diamond layer 23 is formed on the separation layer 22 and, at the same time, the plurality of diamond cathodes 20 are formed in the apertures of the insulating layer 13 respectively as shown in FIG. 3D. After forming the diamond cathodes 20 together with the diamond layer 23, both the separation layer 22 and the diamond layer 23 are removed from the insulating layer 13 through a lift off process as shown in FIG. 3E.

If described in detail, the cathode layer 12 and the insulating layer 13 are orderly formed on the substrate 11 as shown in FIG. 3A. After forming the insulating layer 13 on the cathode layer 12, the insulating layer 13 is subjected to etching using the photoresist 21 applied on the insulating layer 13 as shown in FIG. 3B. In this etching step for forming the apertures in the insulating layer 13, the insulating layer 13 is partially etched into the circular aperture pattern of about 50–100 μm of the photoresist 21, thus to be provided with the apertures having diameters of about 50–100 μm. In this regard, the etching step can be carried out through a photoresist patterning using a typical ultraviolet exposure system.

After forming the circular apertures in the insulating layer 13, the photoresist 21 is removed from the layer 13. The layer 13 free from the photoresist 21 in turn is coated with the separation layer 22 in such a manner that the separation layer 22 is not formed in the apertures but exclusively formed on the insulating layer 13 as shown in FIG. 3C. In this separation layer forming step, the separation layer 22, for example, an aluminum layer, is formed on the insulating layer 13 using an electron beam vacuum depositor while inclination-rotating the substrate 11 at an inclination angle of 10°–20°. It should be understood that means for preventing possible introduction of the material, for example, aluminum, for the separation layer 22 into the apertures of the insulating layer 13 should be provided for the apertures in accordance with the inclination angle of the rotated substrate 11.

The separation layer forming step is followed by a diamond layer and diamond cathode forming step. In the diamond layer and diamond cathode forming step, the plurality of thin film diamond cathodes 20 are formed in the apertures of the insulating layer 13 respectively and, at the same time, the thin film diamond layer 23 is formed on the separation layer 22 through a microwave chemical vapor deposition (CVD) as shown in FIG. 3D.

After forming the diamond cathodes 20 and the diamond layer 23, the separation layer 22 is removed from the insulating layer 13 through the lift off process so that the diamond layer 23 is removed from the insulating layer 13 while remaining the diamond cathodes 20 in the apertures as shown in FIG. 3E. The total process for producing the field emission cathode of the field emission display device is ended at the lift off process for removing the diamond layer 23 and the separation layer 22 from the insulating layer 13. Of course, it should be understood that the process for producing the field emission display device of the invention also includes several steps for forming the fluorescent layer 16, the anode layer 17, the partition 19 and the like.

The step for forming the field emission diamond cathodes 20 is carried out at temperatures of 400°–700° C. The diamond cathodes 20 have a work function of about 2.1 eV which is remarkably lower than that of a typical metal tip cathode. In this regard, the field emission display device of the invention directly forms a strong electric field by the anode layer so that the display device does not need to form the strong electric field by the gate electrode.

Hereinbelow, the operational theory of the above field emission display device will be described with reference to FIG. 2.

In the field emission display device, the substrate 11 provided with the cathode layer 12 and the insulating layer 13 having the diamond cathodes 20 is opposed to the face plate glass 18 provided with the anode layer 17 and the fluorescent layer 16 with interposition of the vacuum region 15 therebetween. The thin film diamond cathodes 20 of the strip type or the X-directional electrodes and the anode layer 17 of the strip type of the Y-directional electrode are opposed to and cross each other with interposition of the partition 19 therebetween. When a potential difference of about 200 V is kept between the cathode layer 12 and the anode layer 17 in this state, electrons are emitted from the surfaces of the diamond cathodes 20 and collide on the fluorescent layer 16 of the anode layer 17, thus to display a desired picture on the fluorescent layer 16. At this time, the vacuum region 15 between the cathode layer 12 and the anode layer 17 is kept at a high vacuum of about $10^{-6}$–$10^{-7}$ torr. The field emission diamond cathodes 20 are such thin film cathodes that ion bombardment of gases remaining in the vacuum region 15 by the electrons emitted from the diamond cathodes 20 does not shorten the expected life span of the diamond cathodes 20.

The following example is merely intended to illustrate the present invention in further detail and should by no means be considered to be limitative of the invention. Please note that the following Example 1 is not for the total process for producing the field emission display device but for several steps for forming the field emission cathodes which are the gist of the present invention.

EXAMPLE 1

A chrome cathode layer was formed on a glass substrate using an electron beam vacuum depositor and, thereafter, a $SiO_2$ insulating layer was formed on the cathode layer using a plasma enhanced chemical vapor deposition (PECVD) system.

Thereafter, a photoresist that had a circular aperture pattern of a diameter of about 70 μm was prepared and applied on the $SiO_2$ insulating layer. Thereafter, a photoresist patterning was carried out using a mask aligner that was a typical ultraviolet exposure system and the $SiO_2$ insulating layer was etched using RIE equipment, thus to form a plurality of circular apertures in the insulating layer.

After etching the insulating layer, the photoresist was removed from the insulating layer having the apertures. An aluminum layer was inclination-deposited on the insulating layer using an electron beam vacuum depositor while rotating the glass substrate at an inclination angle of 15°, thus to form a separation layer on the etched insulating layer.

A thin film diamond cathode was formed in each of the apertures of the insulating layer and, at the same time, a thin film diamond layer was formed on the separation layer through a microwave CVD at a temperature of 500° C.

After forming the diamond cathodes and the diamond layer, the separation layer was removed from the insulating layer through a lift off process so that the diamond layer was removed from the insulating layer along with the separation layer while remaining the diamond cathodes, that is, field emission cathodes, in the apertures.

As a result of practical use of a field emission display device having the above field emission cathodes, the problem caused by the ion bombardment of gases remaining in the vacuum region due to electrons emitted from the cathode was overcome and, furthermore, the expected life span of the field emission cathodes was remarkably lengthened by 10,000–20,000 hours in comparison with a typical display device.

As described above, a field emission display device having field emission cathodes in accordance with the invention allows the minimum size of the aperture pattern to be kept at about 50 μm, so that there is no problem in use of a typical pattern exposure system even when producing a large-sized display device. The display device of the invention uses no gate electrode differently from the typical display device so that the process for producing the display device is simplified by about ⅓ in comparison with the typical process. As the display device production process of the invention forms diamond cathodes in apertures at a low temperature, the display device of the invention uses a general glass substrate and this reduces the cost of the display device by at least 30% in comparison with the typical display device. Another advantage of the display device of the invention is resided in that the problem caused by the ion bombardment of gases remaining in the vacuum region due to electrons emitted from the cathode is overcome and, furthermore, the expected life span of the field emission cathodes was remarkably lengthened by 10,000–20,000 hours in comparison with a typical display device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for producing a field emission display device comprising the steps of:

forming a cathode layer on a substrate and forming an insulating layer on said cathode layer;

etching said insulating layer using a photoresist having a predetermined aperture pattern, thus to form a plurality of apertures in said insulating layer;

removing said photoresist from the insulating layer and forming a separation layer on the insulating layer;

forming a plurality of thin film field emission diamond cathodes in said apertures of the insulating layer respectively and, at the same time, forming a diamond layer on the separation layer; and removing said separation layer together with said diamond layer from the insulating layer through a lift off process.

2. The method according to claim 1, wherein said diamond cathodes are formed in the apertures of the insulating layer respectively through a microwave chemical vapor deposition at a temperature ranged from 400° C. to 700° C.

3. The method according to claim 1, wherein said separation layer is inclination-deposited on the insulating layer using an electron beam vacuum depositor while rotating said glass substrate at an angle of inclination ranged from 10° to 20°.

* * * * *